US008875630B2

(12) United States Patent
Izume et al.

(10) Patent No.: US 8,875,630 B2
(45) Date of Patent: Nov. 4, 2014

(54) PRINTER

(75) Inventors: Masayuki Izume, Kyoto (JP); Tadao Hashimoto, Kyoto (JP); Kenjiro Yamasaki, Kyoto (JP)

(73) Assignee: I. Mer Co., Ltd., Kyoto-Shi (JP)

( * ) Notice: Subject to any disclaimer, the term of this patent is extended or adjusted under 35 U.S.C. 154(b) by 304 days.

(21) Appl. No.: 12/998,789

(22) PCT Filed: May 21, 2009

(86) PCT No.: PCT/JP2009/059314

§ 371 (c)(1),
(2), (4) Date: Jun. 2, 2011

(87) PCT Pub. No.: WO2010/073750

PCT Pub. Date: Jul. 1, 2010

(65) Prior Publication Data

US 2011/0239880 A1 Oct. 6, 2011

(30) Foreign Application Priority Data

Dec. 26, 2008 (JP) ..... 2008-333408

(51) Int. Cl.

| | |
|---|---|
| ***B41F 1/34*** | (2006.01) |
| ***B41F 23/04*** | (2006.01) |
| ***B41F 13/22*** | (2006.01) |
| ***B41F 27/12*** | (2006.01) |

(52) U.S. Cl.

CPC ..... *B41F 13/22* (2013.01); *B41F 27/1206* (2013.01)

USPC ..... 101/480; 101/487; 101/488; 101/216

(58) Field of Classification Search

USPC ..... 101/487, 488, 328, 395, 217, 216, 409, 101/349.1, 480

See application file for complete search history.

(56) References Cited

U.S. PATENT DOCUMENTS

| | | | | |
|---|---|---|---|---|
| 5,595,115 | A * | 1/1997 | Rau et al. | 101/142 |
| 5,784,957 | A | 7/1998 | Rau et al. | |
| 6,109,177 | A * | 8/2000 | Wech et al. | 101/349.1 |

FOREIGN PATENT DOCUMENTS

| | | | |
|---|---|---|---|
| DE | 19957943 | A1 | 6/2001 |
| DE | 102005005303 | A1 | 7/2006 |
| EP | 0693372 | A1 | 1/1996 |
| EP | 1295719 | A2 | 3/2003 |
| EP | 1295719 | A3 | 3/2003 |
| JP | 62-191152 | A | 8/1987 |
| JP | 02-067135 | A | 3/1990 |
| JP | 07-241982 | A | 9/1995 |
| JP | 10-193557 | A | 7/1998 |
| JP | 11-010830 | A | 1/1999 |
| JP | 2000-168037 | A | 6/2000 |
| JP | 2004-050551 | A | 2/2004 |

OTHER PUBLICATIONS

International Search Report dated Jul. 7, 2009, issued for PCT/JP2009/059314.

Supplementary European Search Report dated Apr. 16, 2012, issued in the corresponding European patent application No. 09834556.4.

* cited by examiner

*Primary Examiner* — Matthew G Marini

(74) *Attorney, Agent, or Firm* — Edwards Wildman Palmer LLP

(57) ABSTRACT

The present invention provides a printer which can facilitate temperature control of a machine-plate cylinder section, can allow simple setup, and can facilitate maintenance of printing quality in continuous printing. In the printer, a machine plate is mounted on the outer circumference of a machine-plate cylinder section 12 fixedly provided on a machine-plate drive shaft 1. A fluid whose temperature is regulated is circulated in the machine-plate cylinder section 12.

7 Claims, 10 Drawing Sheets

PRINTER

TECHNICAL FIELD

The present invention relates to a printer.

BACKGROUND ART

There is known a printer in which a machine plate is mounted on the outer circumference of a machine-plate cylinder fixed on a machine-plate drive shaft.

SUMMARY OF THE INVENTION

Problems to be Solved by the Invention

In recent years, demand has increased for designs requiring high-speed, advanced printing techniques. Particularly, absolute mechanical accuracy and temperature control of printer components are essential to waterless lithographic printing and halftone printing. Under the present circumstances, these requirements are addressed by temperature control of a room where a printer is installed, temperature control of an ink can, and temperature control of an ink fountain roller, which partially constitutes an ink fountain.

Essentially, temperature control of a machine-plate cylinder engaged in actual printing is important. However, this temperature control is difficult. According to present practices, cold air is blown against a machine-plate cylinder for cooling purpose.

Accordingly, the temperature of the machine-plate cylinder is not sufficiently controlled, resulting in the following problems.

When printing is to be set up, particularly at low temperature as in winter, a drop in ambient temperature puts the machine-plate cylinder and a machine plate in a cold state. Therefore, a printer requires warm-up operation (idle operation) for a long period of time (e.g., one hour or longer).

In the case where the optimum temperature for printer components is, for example, 28° C. to 30° C., crushing of ink is very poor until the temperature reaches the range. Accordingly, a large number of adjustment ink cans and much time are consumed until a good level of printing quality is reached.

At the time of machine-plate replacement, a machine plate is replaced together with a machine-plate cylinder. Thus, a problem similar to that mentioned above arises, causing an increase in machine-plate replacement time and a required number of adjustment ink cans.

Immediately after start of continuous printing with a mass-printing quality level subsequent to setup, which has consumed a large number of adjustment ink cans and much time, an abrupt temperature rise occurs in the ink fountain roller and the machine-plate cylinder, so that printer components must be cooled. Under the present circumstances, as mentioned above, temperature control of the ink fountain roller is sufficiently performed; however, temperature control of the machine-plate cylinder is insufficient. Thus, ink temperature abruptly rises with machine-plate cylinder temperature, causing a change in ink properties and thus a change in state of crushing of ink and ink transferability. Such a change emerges as ink smudge or color mottle in a halftone area, a fine design area, or a non-image area. Each time such a printing defect is found, an operator must stop a printing line and must clean a machine plate and a blanket as well as deal with defective products which have been conveyed to a subsequent step. Such work imposes a physical burden on the operator. If the operator fails to quickly find ink smudge or color mottle, a lot of defective products will be yielded. Therefore, the operator must pay close attention to inspection of prints, thereby feeling increased psychological burden.

In the case of printing which involves excessively poor crushing of ink and thus a large amount of raised ink, such as solid ground printing in black, in addition to the above-mentioned problems, a problem of ink mist caused by increase in ink temperature comes to the surface; specifically, smudges on components of an inker (ink feeder) increase. An increase in smudges on the inker components leads to scattering or dropping of deposited ink and thus becomes a main cause of trash.

An object of the present invention is to solve the above-mentioned problems and to provide a printer which can facilitate temperature control of a machine-plate cylinder section, can allow simple setup, and can facilitate maintenance of printing quality in continuous printing.

Means for Solving the Problems

The present invention provides a printer in which a machine plate is mounted on an outer circumference of a machine-plate cylinder section fixedly provided on a machine-plate drive shaft. The printer is characterized in that a fluid whose temperature is regulated is circulated in the machine-plate cylinder section.

The constitution of the machine plate mounted on the machine-plate cylinder section, machine-plate mounting means, and a machine-plate mounting method are arbitrary.

The fluid is preferably a liquid, particularly preferably water, which is inexpensive.

Since a liquid whose temperature is regulated is circulated in the machine-plate cylinder section, temperature control of the machine-plate cylinder section can be readily performed. Thus, setup at the time of start of printing or machine-plate replacement can be started in a state in which the temperature of the machine-plate cylinder section is brought within a predetermined range, so that setup can be simplified, and setup time and required adjustment ink cans can be greatly reduced. A reduction in setup time can save energy, such as electricity or gas, required for warm-up operation. Also, during continuous printing, the circulation of the liquid can maintain the machine-plate cylinder section at an appropriate temperature, thereby solving the above-mentioned problems which could otherwise result from a temperature rise of the machine-plate cylinder section. Thus, printing quality is readily maintained. Accordingly, productivity can be greatly improved.

In the printer of the present invention, for example, a fluid circulation space is formed in the machine-plate cylinder section, and there are provided fluid circulation means for circulating the temperature control fluid in the fluid circulation space and temperature control means for controlling temperature of the temperature control fluid according to temperature of the machine-plate cylinder section.

By virtue of the above-mentioned configuration, by means of the fluid circulation means circulating the temperature control fluid whose temperature is regulated by the temperature control means, in the fluid circulation space in the machine-plate cylinder section, temperature control of the machine-plate cylinder section can be readily performed.

In the above-mentioned printer, for example, the interior of the machine-plate cylinder section is circumferentially divided into a plurality of compartments by means of partition walls; a communication hole is formed in each of the partition walls except for one partition wall; and the plurality of compartments which communicate with one another through the communication holes form the fluid circulation space.

By virtue of the above-mentioned configuration, the temperature control fluid can be circulated thoroughly in the machine-plate cylinder section.

In the above-mentioned printer, for example, the machine-plate drive shaft has a liquid inflow channel for allowing the temperature control fluid to flow into the compartment located at one end of the fluid circulation space, and a liquid outflow channel for allowing the temperature control fluid to flow out from the compartment located at the other end of the fluid circulation space, formed therein.

By virtue of the above-mentioned configuration, the temperature control fluid can be readily circulated, through the machine-plate drive shaft, in the fluid circulation space in the machine-plate cylinder section fixedly provided on the machine-plate drive shaft. Therefore, there is no need to externally provide the liquid inflow channel and the liquid outflow channel.

In the above-mentioned printer, for example, the machine-plate cylinder section has an inner tubular portion into which the machine-plate drive shaft is fitted, an outer cylindrical portion whose outer circumference has a machine plate mounted thereon, and end walls for tightly closing up respective opposite ends of the machine-plate cylinder section; a space between the inner tubular portion and the outer cylindrical portion is divided into the plurality of compartments by means of the partition walls; and the inner tubular portion has an inflow hole formed therein for establishing communication between the liquid inflow channel of the machine-plate drive shaft and the compartment located at the one end of the fluid circulation space and an outflow hole formed therein for establishing communication between the liquid outflow channel of the machine-plate drive shaft and the compartment located at the other end of the fluid circulation space.

By virtue of the above-mentioned configuration, the plurality of compartments and the fluid circulation space can be readily formed within the machine-plate cylinder section.

Preferably, the positional relationship among the inflow hole and the outflow hole formed in the inner tubular portion and the communication holes formed in the partition walls is determined such that the temperature control fluid flows over as wide a range of each of the compartments as possible, so as to circulate thoroughly in the compartments.

In the above-mentioned printer, for example, a front end portion of the machine-plate drive shaft is formed into a taper portion, and the tapered inner tubular portion of the machine-plate cylinder section is fitted to the taper portion.

By virtue of the above-mentioned configuration, the inner tubular portion of the machine-plate cylinder section can be brought into close contact with the taper portion of the machine-plate drive shaft, thereby ensuring inflow and outflow of the temperature control fluid.

In the above-mentioned printer, for example, the fluid circulation means comprises a pump, a liquid inflow pipe and a liquid outflow pipe which are connected to the pump, and a rotary joint for establishing communication between the liquid inflow pipe and the liquid inflow channel of the machine-plate drive shaft and communication between the liquid outflow pipe and the liquid outflow channel of the machine-plate drive shaft.

By virtue of the above-mentioned configuration, the temperature control fluid can be readily and reliably circulated in the fluid circulation space in the rotating machine-plate cylinder section through the rotating machine-plate drive shaft.

In the above-mentioned printer, for example, the temperature control means detects temperature of the machine-plate cylinder section and controls temperature of the temperature control fluid in the liquid inflow pipe on the basis of the detected temperature of the machine-plate cylinder section so that temperature of the machine-plate cylinder section falls within a predetermined range.

By virtue of the above-mentioned configuration, the temperature of the machine-plate cylinder section can be controlled more reliably.

In the above-mentioned printer, for example, the temperature control means comprises a temperature sensor for detecting temperature of the machine-plate cylinder section, a heat exchanger provided on the liquid inflow pipe, and a controller for controlling the heat exchanger on the basis of the detected temperature of the machine-plate cylinder section.

The constitution of the temperature sensor and that of the heat exchanger are arbitrary.

By virtue of the above-mentioned configuration, the temperature of the machine-plate cylinder section can be controlled more accurately.

In the above-mentioned printer, for example, the temperature control means further comprises flow control means provided in the liquid inflow pipe, and the controller controls the flow control means on the basis of the detected temperature of the machine-plate cylinder section.

The constitution of the flow control means is arbitrary.

By virtue of the above-mentioned configuration, the temperature of the machine-plate cylinder section can be controlled more accurately.

A machine plate used in the printer of the present invention, for example, has a forme area provided on a portion of the outer circumferential surface of a machine-plate body which is formed from an elastic material into a cylindrical shape, and an engagement portion projecting radially inward from the inner circumference of the machine plate body and extending in the axial direction.

Herein, the term "forme area" means an area where a forme is already formed (processed area), as well as an area where a forme is to be formed and is not yet formed (area to be processed).

In order to mount such a machine plate, the printer has a machine-plate mounting device including a machine-plate cylinder section.

The machine-plate mounting device, for example, comprises the machine-plate cylinder section fixedly provided on a machine-plate drive shaft and having, on its outer circumference, a cylindrical machine-plate mounting surface on which a machine plate is mounted from a front-end side of the machine-plate drive shaft, and is characterized in the following: the machine-plate cylinder section has, on its outer circumference, a groove for circumferential positioning into which an engagement portion of the machine plate is fitted from the front-end side of the machine-plate drive shaft; a stopper for axial positioning with which an end portion of the machine plate comes into contact; and a machine-plate fixation member which presses a portion, other than the forme area, of the machine plate mounted on the machine-plate cylinder section from the radial inside direction toward the radial outside direction so as to bring the machine plate into fixed close contact with the machine-plate mounting surface of the machine-plate cylinder section.

The forme area is formed on a portion of the machine plate which, when the machine plate is mounted on the machine-plate cylinder section, comes into close contact with the machine-plate mounting surface.

The inner diameter of the machine plate is slightly greater than the outer diameter of the machine-plate mounting surface of the machine-plate cylinder section as measured at the same temperature.

When the machine plate is to be attached to the machine-plate mounting device, the machine-plate fixation member is in such a state as to not press the machine plate radially outward. In this state, the machine plate is fitted, from its one end portion, to the outer circumference of the machine-plate cylinder section in such a manner that the engagement portion of the machine plate is fitted into the groove of the machine-plate cylinder section and that the one end portion of the machine plate comes into contact with the stopper. By this procedure, the machine plate is attached to the machine-plate cylinder section at a predetermined position in an accurate, simple manner. Since the inner diameter of the machine plate is greater than the outer diameter of the machine-plate mounting surface and since, when the machine plate is attached, the machine-plate fixation member is in such a state as to not press the machine plate radially outward, a clearance exists between the machine plate and the machine-plate mounting surface, so that the machine plate can be readily attached to the machine-plate cylinder section. After the machine plate is attached, the machine-plate fixation member is brought into such a state as to press the machine plate radially outward, thereby bringing the machine plate in fixed close contact with the machine-plate mounting surface. At this time, the engagement portion of the machine plate is fitted into the groove of the machine-plate cylinder section, and one end portion of the machine plate is in contact with the stopper, whereby the machine plate is positioned with respect to the circumferential direction and the axial direction of the machine plate and is fixed at the position by means of the machine-plate fixation member. Therefore, during operation, the position of the machine plate does not deviate in relation to the machine-plate cylinder section.

Preferably, the difference between the inner diameter of the machine plate and the outer diameter of the machine-plate mounting surface as measured at the same temperature is as small as possible within a range at which the machine plate can be readily attached to and detached from the machine-plate cylinder section.

When the machine plate is to be detached from the machine-plate mounting device, the machine-plate fixation member is brought in such a state as to not press the machine plate radially outward. In this state, a clearance is formed between the machine plate and the machine-plate mounting surface. Thus, the machine plate can be moved in the axial direction and readily detached from one end of the machine-plate cylinder section.

Preferably, the engagement portion is formed obliquely with respect to the machine-plate body such that, when the machine plate mounted on the machine-plate cylinder section is rotated, the projecting end of the engagement portion is located rearward of the root of the engagement portion with respect to the rotational direction. More preferably, the angle between the engagement portion and the machine-plate body is 35 degrees to 55 degrees inclusive. Most preferably, the angle is 45 degrees. The groove of the machine-plate cylinder section is also formed obliquely in accordance with the profile of the engagement portion such that its bottom portion is located rearward of its opening portion with respect to the rotational direction.

By virtue of the above-mentioned configuration, when the machine-plate cylinder section rotates, the engagement portion bites into the groove, so that the position of the machine plate is free from deviation.

Preferably, the machine plate is formed such that: a rectangular sheet of an elastic material is formed into a cylindrical shape with opposite end portions joined together in an overlapping condition, thereby forming the cylindrical machine-plate body; an end portion of the sheet located on the inner side of a joint portion is bent inward, thereby forming the engagement portion; and the forme area is provided at a predetermined portion of the outer circumferential surface of the machine-plate body excluding the joint portion.

In this case, preferably, the machine-plate fixation member presses the joint portion of the machine plate.

Preferably, the bending angle of the engagement portion is greater than 90 degrees.

The "bending angle" is an angle of bending the engagement portion from a state of the flat sheet. Therefore, the angle between the engagement portion and an adjacent portion of the sheet (sheet-engagement-portion angle) is a value obtained by subtracting the bending angle from 180 degrees.

When the bending angle of the engagement portion is rendered greater than 90 degrees, the sheet-engagement-portion angle becomes smaller than 90 degrees.

Preferably, the bending angle is 125 degrees to 145 degrees inclusive (the sheet-engagement-portion angle is 55 degrees to 35 degrees inclusive). Most preferably, the bending angle is 135 degrees (the sheet-engagement-portion angle is 45 degrees).

Even in this case, preferably, the machine-plate cylinder section is rotated in such a direction that an end portion of the sheet, which is used to form the machine-plate body, associated with the engagement portion becomes a rotationally leading end. By virtue of such rotation, the projecting end of the engagement portion faces rearward with respect to the rotational direction. Thus, as the machine-plate cylinder section rotates, the engagement portion bites into the groove, so that the position of the machine plate is free from deviation.

In the above-mentioned machine-plate mounting device, for example, the machine-plate fixation member can move between a position located radially inward of the cylindrical surface, including the machine-plate mounting surface, of the machine-plate cylinder section and a position located radially outward of the cylindrical surface, and can be fixed at an arbitrary position between the positions.

In this case, when the machine plate is to be attached to or detached from the machine-plate cylinder section, the machine-plate fixation member is fixed at a position located radially inward of the cylindrical surface including the machine-plate mounting surface so as to not press the machine plate. After the machine plate is attached to the machine-plate cylinder section, the machine-plate fixation member is fixed at a position located radially outward of the cylindrical surface including the machine-plate mounting surface, whereby the machine-plate fixation member presses the machine plate radially outward, thereby bringing the machine plate into close contact with the machine-plate mounting surface.

By virtue of the above-mentioned configuration, by means of merely moving the machine-plate fixation member to an arbitrary position and fixing it at the position, the machine plate can be readily attached, detached, or fixed.

In the above-mentioned machine-plate mounting device, for example, a portion of the outer cylindrical surface of the machine-plate cylinder section is removed along the circumferential direction, thereby forming a machine-plate fixation member mounting surface located radially inward of the cylindrical surface including the machine-plate mounting surface. Also, the machine-plate fixation member is fitted in a radially movable manner into a machine-plate fixation member reception recess formed on the machine-plate fixation member mounting surface.

In this case, preferably, the machine-plate fixation member is disposed at a circumferentially intermediate portion of the machine-plate fixation member mounting surface or rearward of the circumferentially intermediate portion with respect to the rotational direction, and the groove is provided, on the machine-plate fixation member mounting surface, frontward of the machine-plate fixation member with respect to the rotational direction.

In the above-mentioned machine-plate mounting device, for example, a wedge member having a radially outer wedge surface is fitted in an axially movable manner into a wedge member reception recess formed on the bottom of the recess of the machine-plate fixation member mounting surface; screw means is provided in the machine-plate cylinder section for axially moving the wedge member and stopping the wedge member at an axially arbitrary position; the machine-plate fixation member has a radially inner wedge surface in contact with the wedge surface of the wedge member; and urging means is provided between the machine-plate cylinder section or the wedge member and a machine-plate fixation member, for urging the machine-plate fixation member radially inward by use of permanent magnets so as to bring the wedge surface of the machine-plate fixation member in pressure contact with the wedge surface of the wedge member.

By virtue of the above-mentioned configuration, by means of merely moving the wedge member and fixing the wedge member at an arbitrary position, the machine plate can be readily attached, detached, or fixed.

In the case of use of the above-mentioned machine plate having the engagement portion formed on the inner circumference of the machine-plate body, the machine-plate mounting device may comprise a machine-plate cylinder section fixedly provided on a machine-plate drive shaft and having, on the outer circumference, a cylindrical machine-plate mounting surface on which the machine plate is mounted from the front-end side of the machine-plate drive shaft, and may be configured as follows: the machine-plate cylinder section has, on the outer circumference, a groove for circumferential positioning into which the engagement portion of the machine plate is fitted from the front-end side of the machine-plate drive shaft, and a stopper for axial positioning with which an end portion of the machine plate comes into contact.

In this case, the above-mentioned machine-plate fixation member is unnecessary, and, for example, the entire outer circumference of the machine-plate cylinder section serves as a cylindrical machine-plate mounting surface.

In this case, the inner diameter of the machine plate is slightly smaller than the outer diameter of the machine-plate mounting surface of the machine-plate cylinder section as measured at the same temperature.

When the machine plate is to be attached to the machine-plate mounting device, the temperature of the machine-plate cylinder section is lowered so as to render the inner diameter of the machine plate slightly greater than the outer diameter of the machine-plate mounting surface through shrinkage of the machine-plate cylinder section. If necessary, the machine plate is placed beforehand in an environment having a relatively high temperature for expanding the machine plate. The machine plate whose inner diameter is rendered greater than the outer diameter of the machine-plate mounting surface is fitted, from its one end portion, to the outer circumference of the machine-plate cylinder section in such a manner that the engagement portion of the machine plate is fitted into the groove of the machine-plate cylinder section and that the one end portion of the machine plate comes into contact with the stopper. Subsequently, the temperature of the machine-plate cylinder section is brought to an appropriate level. Consequently, the machine-plate cylinder section and the machine plate have the same temperature, so that the machine plate is fixed to the machine-plate mounting surface in a press fit condition. When the machine plate is to be detached from the machine-plate mounting device, the temperature of the machine-plate cylinder section is lowered, and, as needed, the temperature of the machine plate is increased, so as to render the inner diameter of the machine plate slightly greater than the outer diameter of the machine-plate mounting surface.

The machine plate to be used with the printer of the present invention, for example, has a forme area formed on at least a portion of the outer circumferential surface of the cylindrical machine-plate body and a concavity-convexity for circumferential positioning formed at the one end portion of the machine-plate body; i.e., the machine plate does not have the aforementioned engagement portion.

In this case, the machine-plate mounting device, for example, comprises a machine-plate cylinder section fixedly provided on a machine-plate drive shaft and having, on the outer circumference, a cylindrical machine-plate mounting surface on which the machine plate is mounted from the front-end side of the machine-plate drive shaft, and is configured as follows: the machine-plate cylinder section has, on the outer circumference, a stopper for axial positioning with which an end portion of the machine plate comes into contact, and a concavity-convexity for circumferential positioning to which the concavity-convexity of the machine plate is fitted.

In this case, the above-mentioned machine-plate fixation member is unnecessary, and, for example, the entire outer circumference of the machine-plate cylinder section serves as a cylindrical machine-plate mounting surface.

Also, in this case, the inner diameter of the machine plate is slightly smaller than the outer diameter of the machine-plate mounting surface of the machine-plate cylinder section as measured at the same temperature.

When the machine plate is to be attached to the machine-plate mounting device, the temperature of the machine-plate cylinder section is lowered, and, as needed, the temperature of the machine plate is increased, so as to render the inner diameter of the machine plate slightly greater than the outer diameter of the machine-plate mounting surface. If necessary, the machine plate is placed beforehand in an environment having a relatively high temperature for expanding the machine plate. The machine plate whose inner diameter is rendered greater than the outer diameter of the machine-plate mounting surface is fitted, from its one end portion, to the outer circumference of the machine-plate cylinder section in such a manner that the one end portion of the machine plate comes into contact with the stopper and that the concavity-convexity for circumferential positioning of the place is fitted to that of the machine-plate cylinder section. Subsequently, the temperature of the machine-plate cylinder section is brought to an appropriate level. Consequently, the machine-plate cylinder section and the machine plate have the same temperature, so that the machine plate is fixed to the machine-plate mounting surface in a press fit condition. When the machine plate is to be detached from the machine-plate mounting device, the temperature of the machine-plate cylinder section is lowered, and, as needed, the temperature of the machine plate is increased, so as to render the inner diameter of the machine plate slightly greater than the outer diameter of the machine-plate mounting surface.

The machine plate to be used with the printer of the present invention may not have the above-mentioned cylindrical shape. For example, a single or a plurality of forme sheets may be mounted on the outer circumference of the machine-plate cylinder section by appropriate means.

Effect of the Invention

As mentioned above, the printer of the present invention can facilitate temperature control of a machine-plate cylinder section, can allow simple setup, and can facilitate maintenance of printing quality in continuous printing.

DESCRIPTION OF REFERENCE NUMERALS

Figure 1:
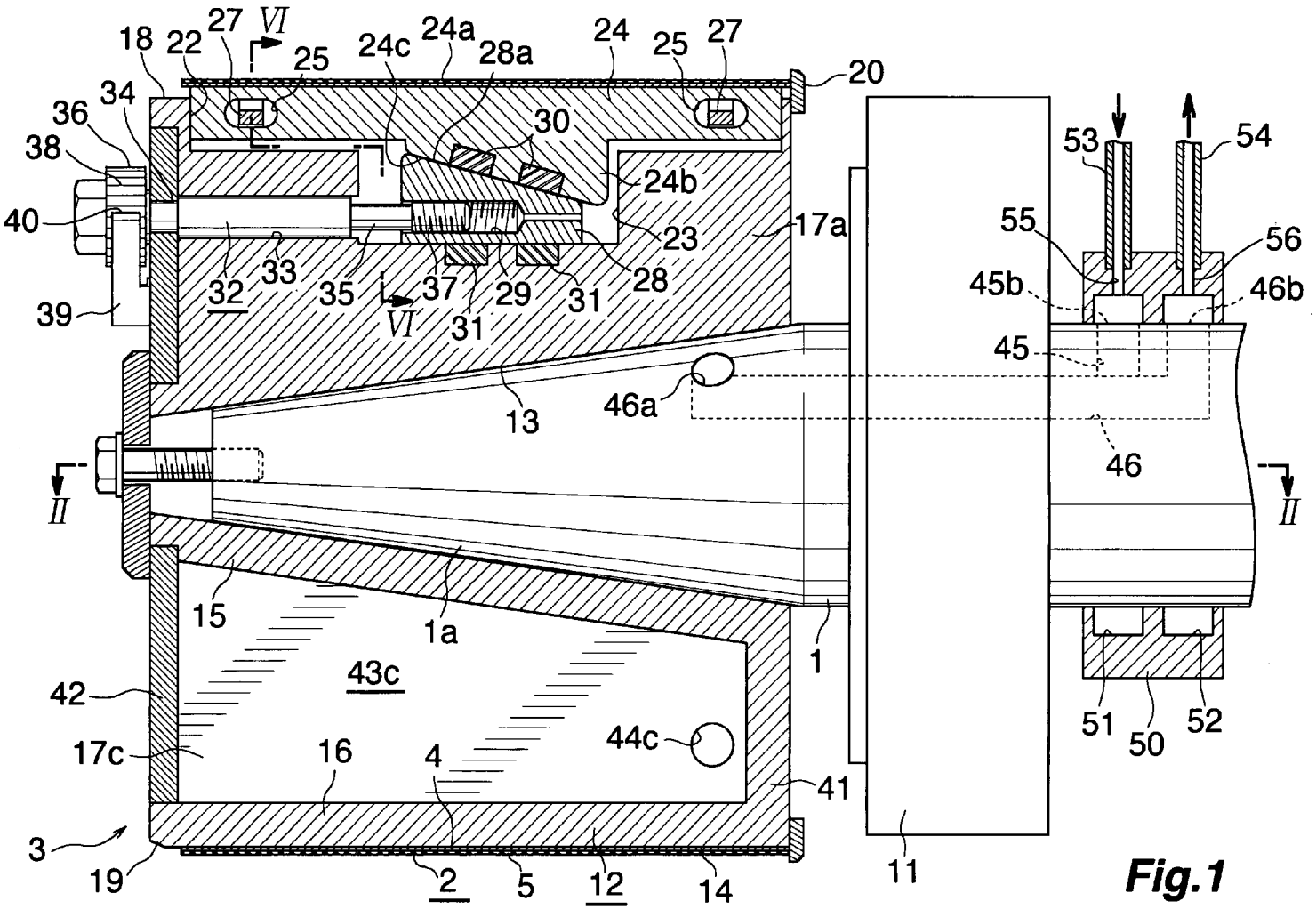
FIG. 1 is a vertical sectional view of a machine-plate mounting device of a printer according to a first embodiment of the present invention.

1: machine-plate drive shaft
1*a*: taper portion
4, 63: machine-plate body
12: machine-plate cylinder section
15: inner tubular portion
16: outer cylindrical portion
17*a*, 17*b*, 17*c*, 17*d*: partition wall
41: rear end wall
42: cover
43*a*, 43*b*, 43*c*, 43*d*: compartment
44*a*, 44*b*, 44*c*: communication hole
45: liquid inflow channel
46: liquid outflow channel
47: inflow hole
48: outflow hole
50: rotary joint
53: liquid inflow pipe
54: liquid outflow pipe
57: pump
58: controller
59: heat exchanger
60: flow control valve
61: temperature sensor

MODES FOR CARRYING OUT THE INVENTION

Embodiments of the present invention will next be described with reference to the drawings.

FIGS. 1 to 9 show a first embodiment.

Figure 2:
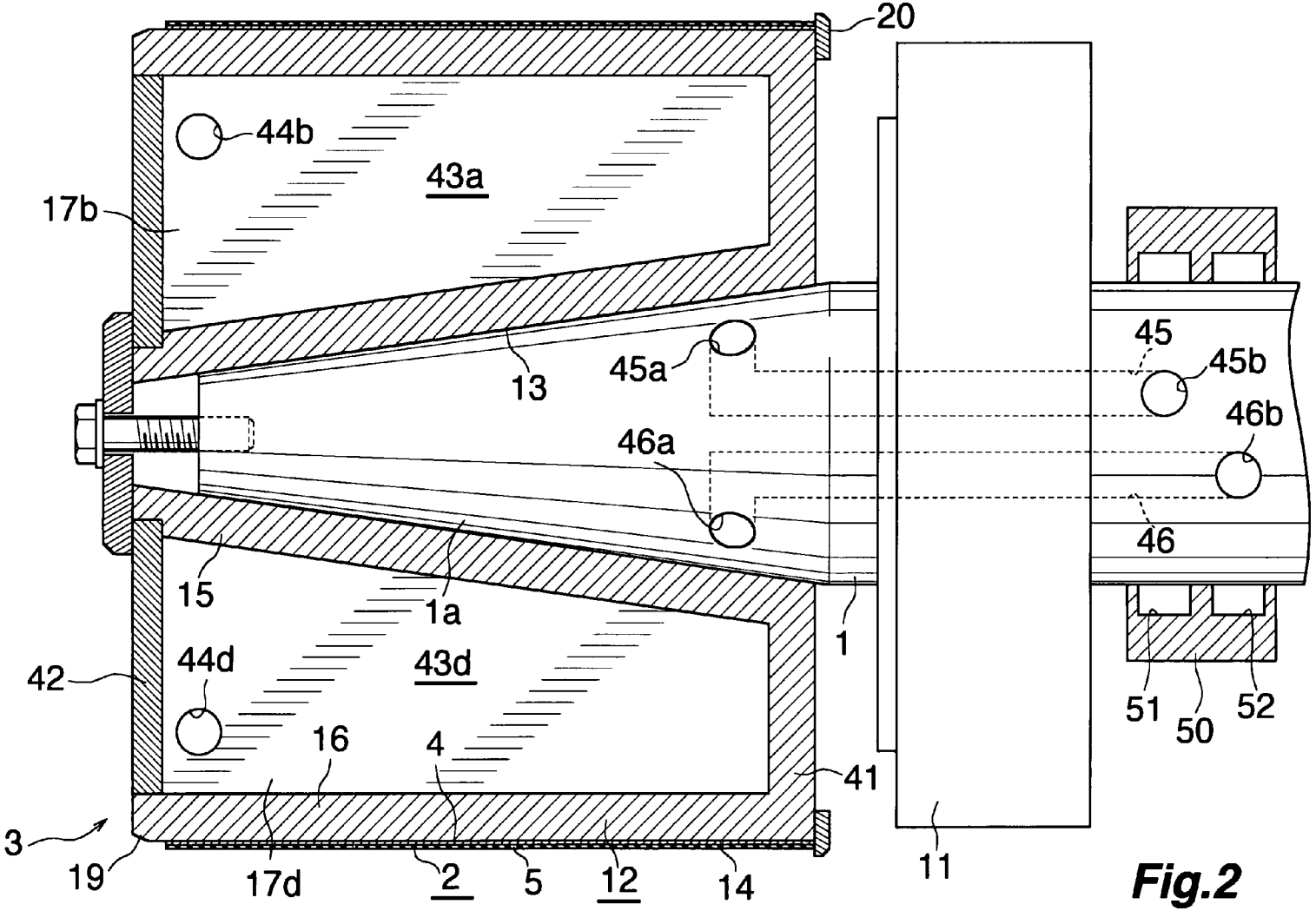
FIG. 2 is a sectional view taken along line II-II of FIG. 1.
Figure 3:
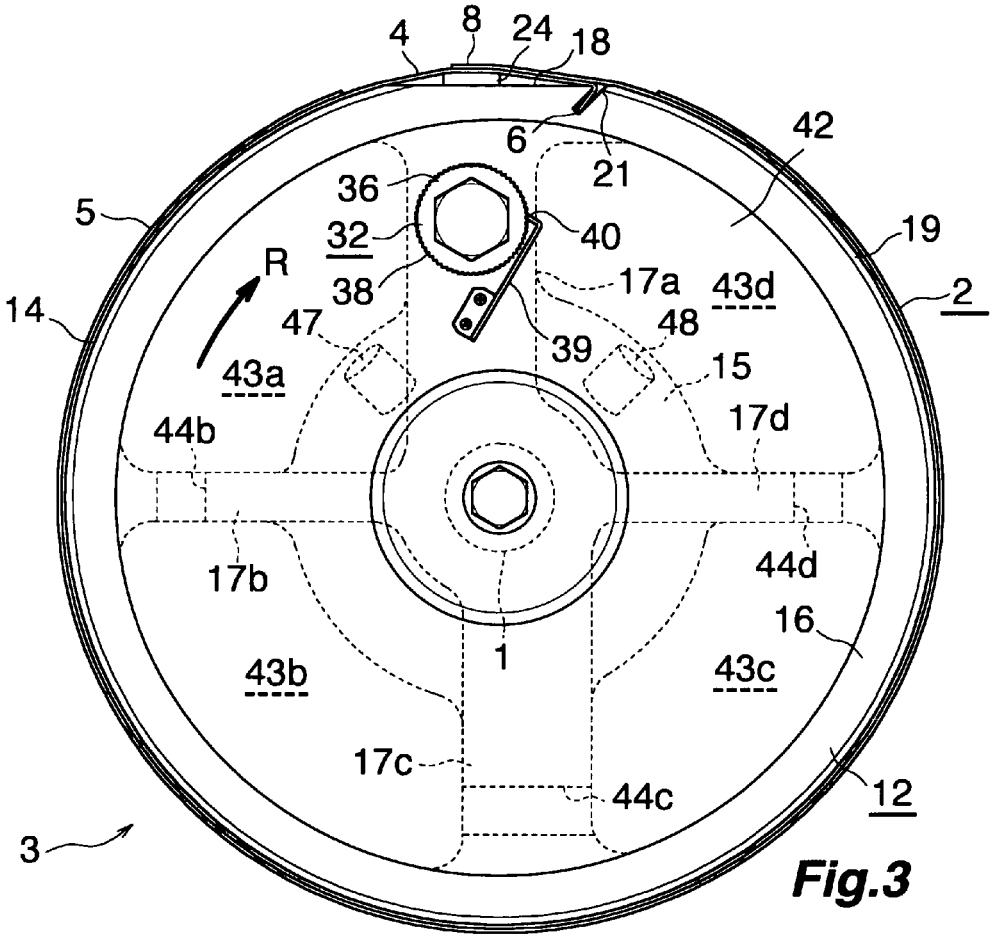
FIG. 3 is a front view of the machine-plate mounting device.
Figure 4:
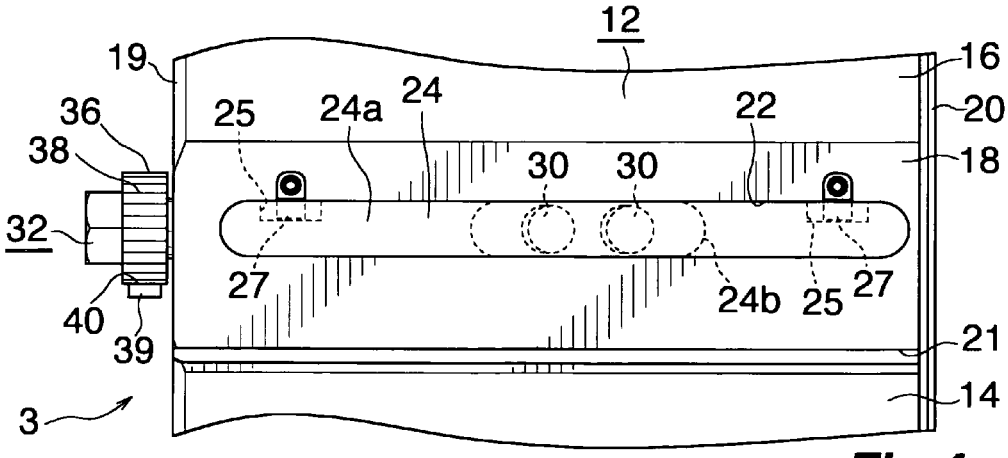
FIG. 4 is a plan view showing a portion of the machine-plate mounting device.
Figure 5:
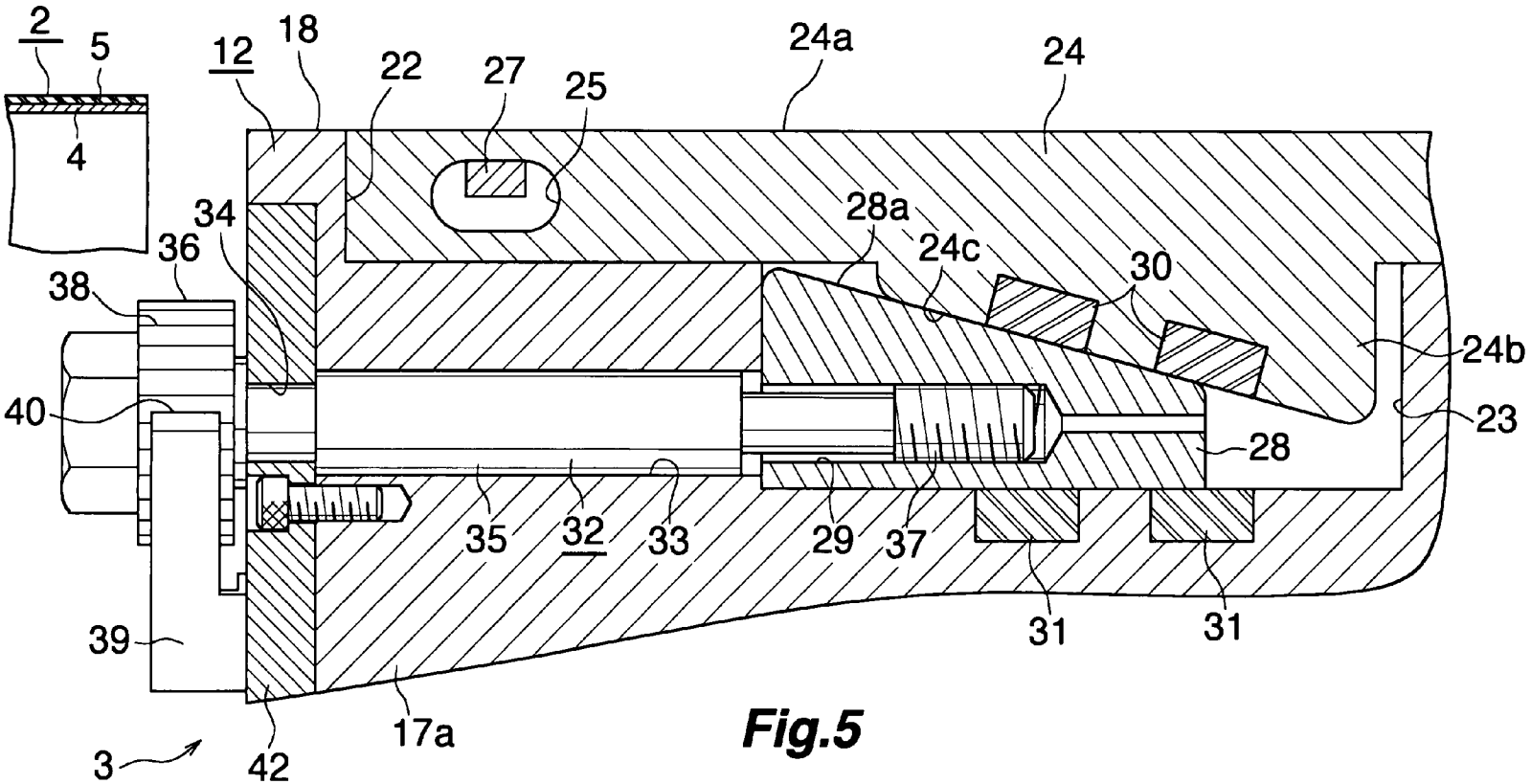
FIG. 5 is a vertical sectional view showing, on an enlarged scale, a portion of the machine-plate mounting device and a portion of a machine plate as viewed before the machine plate is mounted on the machine-plate mounting device.
Figure 6:
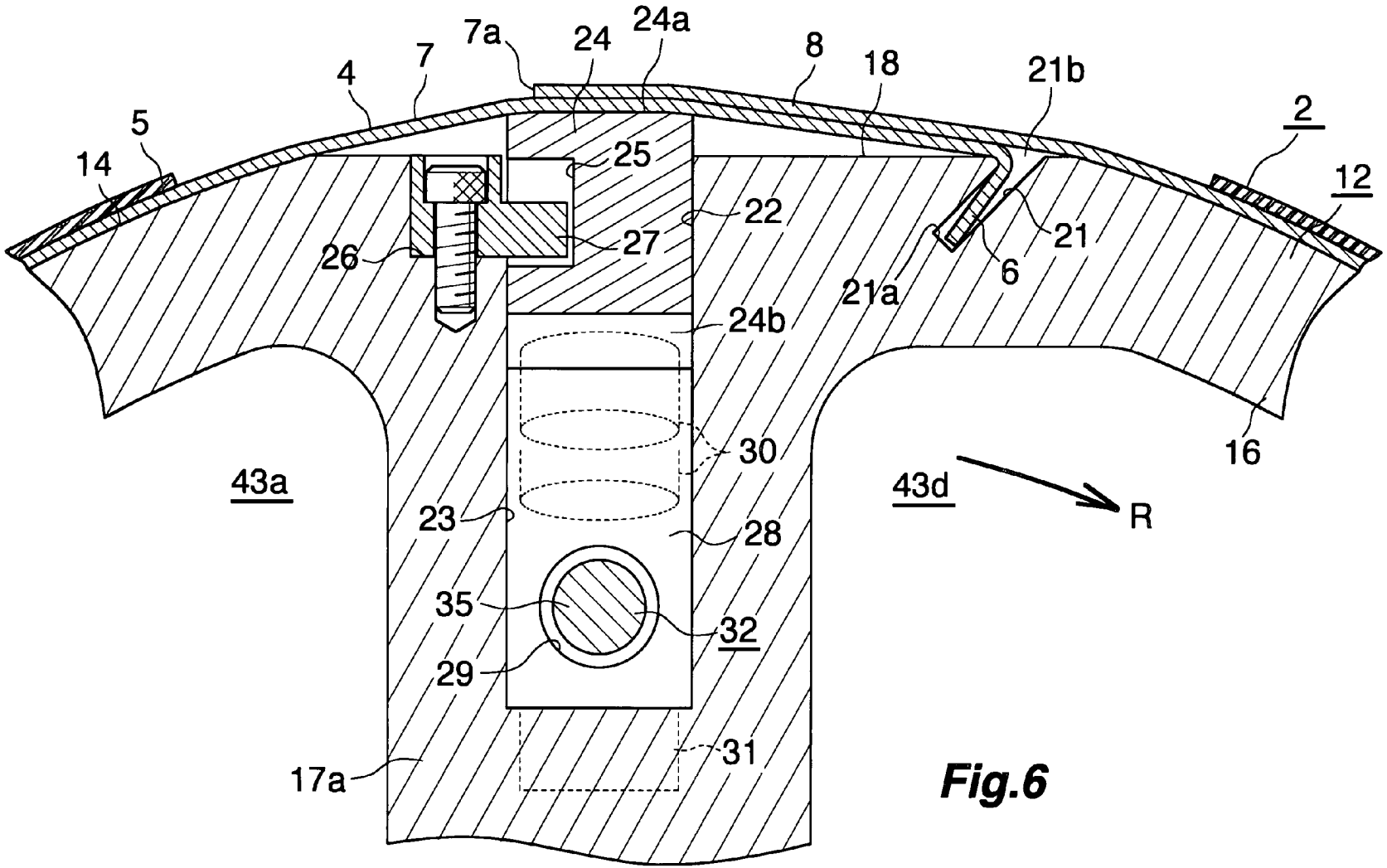
FIG. 6 is a sectional view (cross-sectional view) taken along line VI-VI of FIG. 1.
Figure 7:
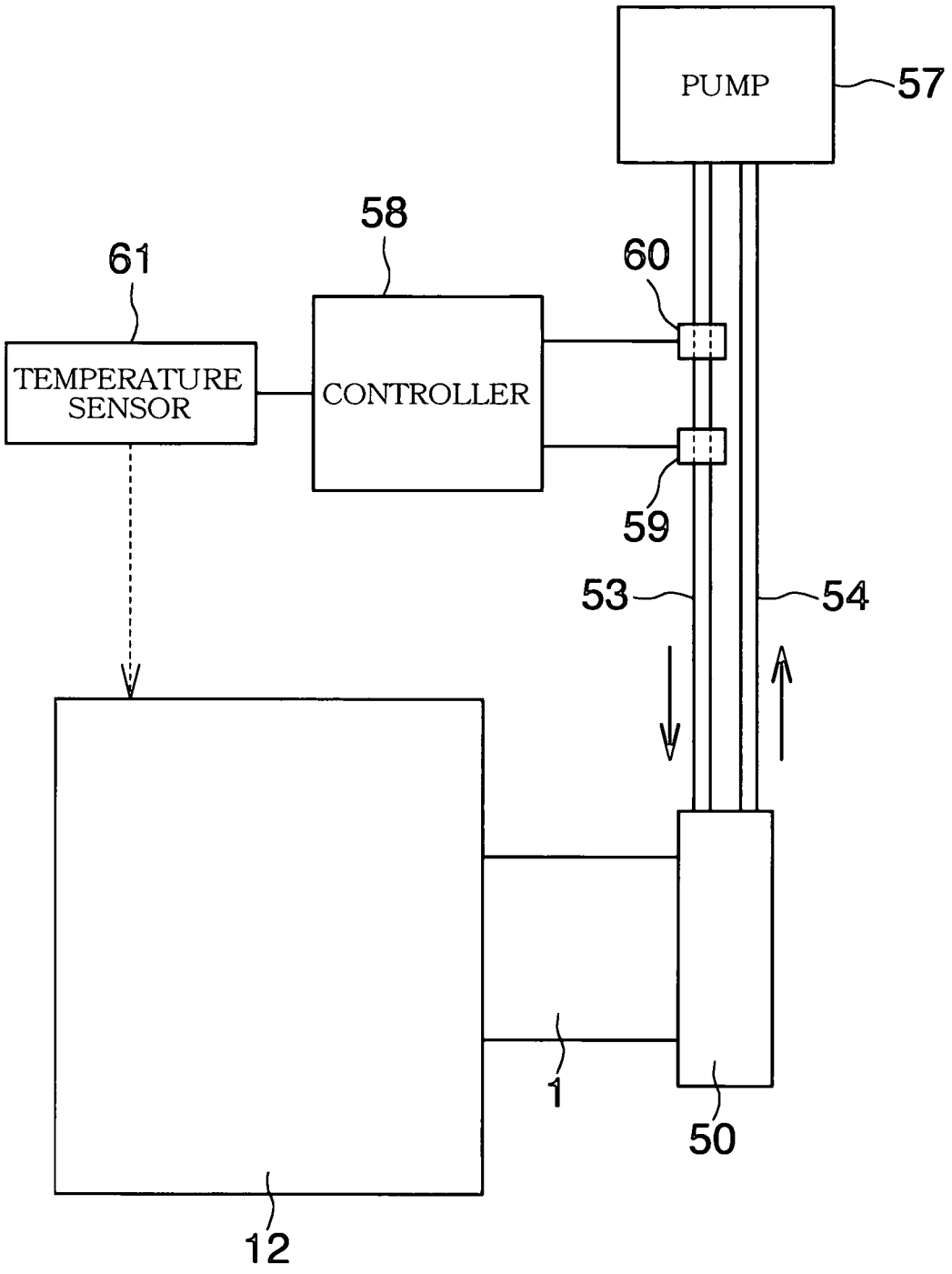
FIG. 7 is a configurational view showing a temperature control section of the machine-plate mounting device.
Figure 8:
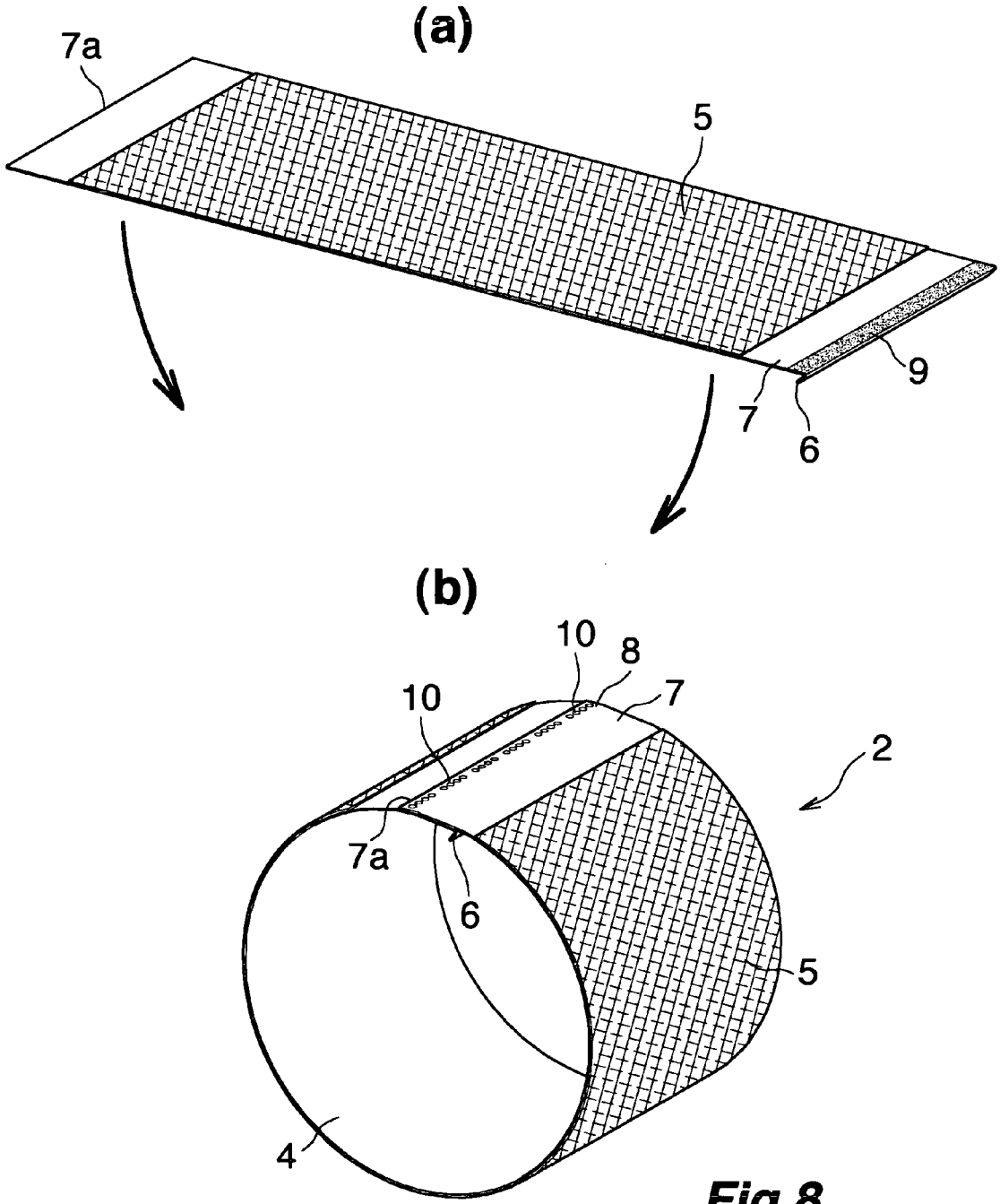
FIG. 8 is a pair of perspective views showing a machine plate and a machine-plate manufacturing step.
Figure 9:
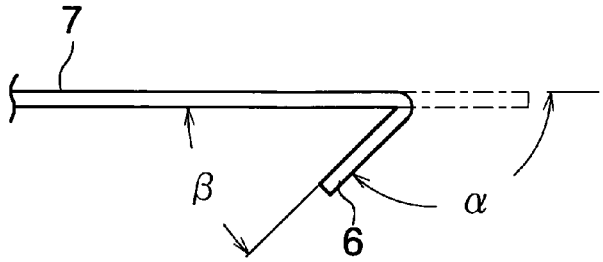
FIG. 9 is a side view showing, on an enlarged scale, a portion of a sheet as viewed before formation of the machine plate of FIG. 8.

FIG. 1 is a vertical sectional view of a machine-plate mounting device 3 of a printer, the machine-plate mounting device 3 being attached to a machine-plate drive shaft 1 of the printer and having a machine plate 2 mounted thereon. FIG. 2 is a sectional view taken along line II-II of FIG. 1. FIG. 3 is a front view of the machine-plate mounting device 3 of FIG. 1. FIG. 4 is a plan view showing a portion of the machine-plate mounting device 3. FIG. 5 is a vertical sectional view showing, on an enlarged scale, a portion of the machine-plate mounting device 3 and a portion of the machine plate 2 as viewed before the machine plate 2 is mounted on the machine-plate mounting device 3. FIG. 6 is a sectional view (cross-sectional view) taken along line VI-VI of FIG. 1. FIG. 7 is a configurational view showing a temperature control section of the machine-plate mounting device 3. FIG. 8 is a pair of perspective views showing the machine plate 2 and a machine-plate manufacturing step. FIG. 9 is a side view showing, on an enlarged scale, a portion of a sheet as viewed before formation of the machine plate of FIG. 8. In the following description, the upper and lower sides of FIG. 1 will be referred to as "upper" and "lower," respectively. The left-hand and right-hand sides of FIG. 1 will be referred to as "front" and "rear," respectively. The left-hand and right-hand sides as viewed from the front toward the rear will be referred to as "left" and "right," respectively.

The machine plate 2 has a forme area 5 provided on a portion of the outer circumferential surface of a machine-plate body 4 which is formed from an elastic material into a cylindrical shape, and an engagement portion 6 projecting radially inward from the inner circumference of the machine-plate body 4 and extending in the axial direction. In this example, as shown in FIG. 8(*b*), the machine plate 2 is formed such that: a rectangular sheet 7 of an elastic material is formed into a cylindrical shape with its opposite end portions joined together in an overlapping condition, thereby forming the cylindrical machine-plate body 4; an end portion of the sheet 7 located on the inner side of a joint portion 8 is bent inward, thereby forming the engagement portion 6; and the forme area 5 is provided at a predetermined portion of the outer circumferential surface of the machine-plate body 4 excluding the joint portion 8. The machine-plate body 4 is formed from an appropriate magnetic or nonmagnetic metal. In this example, SS steel, which is a general structural steel, is used to form the machine-plate body 4. The thickness of the sheet 7 may be such that the sheet 7 can be formed into a cylindrical shape and such that the cylindrical shape can be maintained by an elastic force. In this example, the thickness of the sheet 7 is about 0.24 mm. A joining means for the sheet 7 is arbitrary. In this example, an adhesive and spot welding are used as the joining means.

The forme area 5 is provided at a predetermined portion of the outer circumferential surface of the machine-plate body 4 excluding the joint portion 8.

An end portion of the sheet 7 located on the inner side of the joint portion 8 is bent inward, thereby forming the engagement portion 6. In FIG. 9, an angle $\alpha$ at which the engagement portion 6 is actually bent from a flat state of the sheet 7 represented by the chain line is called the bending angle, and an angle β between the engagement portion 6 and an adjacent portion of the sheet 7 is called the sheet-engagement-portion angle. The bending angle α is preferably greater than 90 degrees (the sheet-engagement-portion angle β is less than 90 degrees), more preferably 125 degrees to 145 degrees inclusive (the sheet-engagement-portion angle β is 55 degrees to 35 degrees inclusive), most preferably 135 degrees (the sheet-engagement-portion angle β is 45 degrees). In this example, the bending angle α is about 135 degrees, and the sheet-engagement-portion angle β is about 45 degrees.

A method of manufacturing the machine plate 2 is arbitrary. Next, an example method of manufacturing the machine plate 2 will be described with reference to FIG. 8.

First, as shown in FIG. 8(*a*), the engagement portion 6 is formed at an end portion of the rectangular sheet 7, and the forme area 5 is formed at a predetermined portion of the sheet 7 excluding opposite end portions. Then, an appropriate adhesive 9 is applied to the surface of an end portion of the sheet 7 associated with the engagement portion 6, the surface being located on a side opposite the engagement portion 6. Next, as shown in FIG. 8(*b*), the sheet 7 is formed into a cylindrical shape; an opposite end portion 7*a* of the sheet 7 is externally overlaid on the adhesive 9 for joining; and joining of the joint portion 8 is enhanced by spot welding. In FIG. 8(*b*), reference numeral 10 denotes spot-welded zones. Forming a forme in the forme area 5; i.e., a forme-making process, may be performed on the forme area 5 of the sheet 7 of FIG. 8(*a*) or on the forme area 5 of the cylindrical machine plate 2 of FIG. 8(*b*).

Next, the configuration of the machine-plate mounting device 3 will be described with reference to FIGS. 1 to 7.

In FIG. 1, reference numeral 11 denotes a bearing housing provided in an unillustrated machine frame of the printer. A front portion of the machine-plate drive shaft 1 is supported rotatably by the bearing housing 11, and a rear portion of the machine-plate drive shaft 1 is supported rotatably by an unillustrated bearing housing provided in the machine frame. The shaft 1 is rotated in a predetermined direction (in this example, clockwise as viewed from the front side) at a predetermined speed by a known drive means. A portion of the machine-plate drive shaft 1 located toward the front end of the shaft 1 projects frontward from the bearing housing 11. A front end portion of the shaft 1 located frontward of the bearing housing 11 is formed into a taper portion 1*a*.

The machine-plate mounting device 3 is removably fixed on the shaft taper portion 1*a*.

The machine-plate mounting device 3 includes a machine-plate cylinder section 12 to be fixed on the shaft taper portion 1*a*. The machine-plate cylinder section 12 has a taper hole 13, which is formed at its center and whose diameter reduces frontward, and assumes a cylindrical shape. The machine-plate cylinder section 12 also has a cylindrical machine-plate mounting surface 14, which is formed on its outer circumference and is concentric with the machine-plate drive shaft 1. The machine-plate cylinder section 12 includes an inner tubular portion 15 having the taper hole 13 and assuming a taper shape; an outer cylindrical portion 16 having the machine-plate mounting surface 14 formed on its outer circumference; and a plurality of (in this example, four) partition walls 17*a*, 17*b*, 17*c*, and 17*d*, which connect the inner tubular portion 15 and the outer cylindrical portion 16 together. The partition walls are generally denoted by reference numeral 17. For identification of the individual partitions, the partitions are called, from the top one in the counterclockwise direction as viewed from the front, the first partition wall 17*a*, the second partition wall 17*b*, the third partition wall 17*c*, and the fourth partition wall 17*d*. An annular space between the inner tubular portion 15 and the outer tubular portion 16 is closed at its rear end with an integrally formed annular rear end wall 41. The annular space is closed at its front end with an annular cover 42, which is fixed to the front end of the annular space and serves as a front end wall. The annular space in the machine-plate cylinder section 12 which is enclosed with the inner tubular portion 15, the outer cylindrical portion 16, the rear end wall 41, and the cover 42 is circumferentially divided by the partition walls 17 into a plurality of (in this example, four) compartments 43*a*, 43*b*, 43*c*, and 43*d*. The compartments are generally denoted by reference numeral 43. For identification of the individual compartments, the compartments are called, from the one between the first partition wall 17*a* and the second partition wall 17*b* in the counterclockwise direction as viewed from the front, the first compartment 43*a*, the second compartment 43*b*, the third compartment 43*c*, and the fourth compartment 43*d*. The machine-plate cylinder section 12 is fixed on the shaft 1 in such a state that the taper hole 13 is fitted to the shaft taper portion 1*a*, and rotates together with the machine-plate drive shaft 1. In FIGS. 3 and 6, the rotational direction of the machine-plate cylinder section 12 is indicated by arrow R.

At an upper portion of the outer cylindrical portion 16 of the machine-plate cylinder section 12 corresponding to the first partition wall 17*a*, a portion of the cylindrical surface is removed so as to form a flat, machine-plate fixation member mounting surface 18. The outer circumference of the outer cylindrical portion 16 excluding the machine-plate fixation member mounting surface 18 serves as the machine-plate mounting surface 14. The forme area 5 of the machine plate 2 is formed at a portion of the machine-plate body 4 which comes in close contact with the machine-plate mounting surface 14 when the machine plate 2 is mounted on the machine-plate cylinder section 12. The circumferential length of the machine-plate mounting surface 14 is longer than that of the forme area 5. The machine-plate fixation member mounting surface 18 is located radially inward of the cylindrical surface including the machine-plate mounting surface 14. A taper surface 19 is formed, by chamfering, at a front end portion of the machine-plate mounting surface 14. The outer diameter of the machine-plate mounting surface 14 is slightly smaller than the inner diameter of the machine plate 2 as measured at the same temperature.

An annular stopper 20 for axial positioning is fixed to an outer circumferential portion of the rear end surface of the outer cylindrical portion 16 of the machine-plate cylinder section 12 in such a manner as to slightly project radially outward beyond the machine-plate mounting surface 14.

A groove 21 for circumferential positioning into which the engagement portion 6 of the machine plate 2 is fitted is formed at a front end portion, with respect to the rotational direction, of the machine-plate fixation member mounting surface 18 in such a manner as to extend along the overall axial length. The angle between the groove 21 and the cylindrical surface including the machine-plate mounting surface 14 is equal to the sheet-engagement-portion angle β of the engagement portion 6 of the machine plate 2. The groove 21 is formed such that its bottom portion 21*a* is located rearward of its opening portion 21*b* with respect to the rotational direction.

A first recess (machine-plate fixation member reception recess) 22 is formed at a portion of the machine-plate fixation member mounting surface 18 which is located rearward of the groove 21 with respect to the rotational direction; in this example, at a portion of the machine-plate fixation member mounting surface 18 which is located rearward, with respect to the rotational direction, of a circumferentially intermediate portion of the machine-plate fixation member mounting surface 18. As viewed from the radially outer side, the recess 22 assumes such a rectangular shape that extends along almost all the axial length of the machine-plate fixation member mounting surface 18. The recess 22 has a rectangular cross-sectional shape. The recess 22 has a flat bottom wall and two flat side walls. A second recess (wedge member reception recess) 23 shorter than the first recess 22 is formed at a longitudinally intermediate portion of the first recess 22 in such a manner that a portion of the first recess 22 is extended radially inward. The second recess 23 has a rectangular cross-sectional shape as well as a flat bottom wall and two flat side walls.

A machine-plate fixation member 24, which is elongated in the front-rear direction, is fitted into the first recess 22 in such a manner as to be movable in the radial direction of the shaft 1. The machine-plate fixation member 24 is fitted into the recess 22 with almost no clearance being left in the circumferential direction and in the axial direction and moves in a radial direction along the two circumferential side walls and two axial end walls of the recess 22. A radially outer end surface 24*a* of the machine-plate fixation member 24 is a flat surface parallel with the machine-plate fixation member mounting surface 18. The end surface 24*a* may be a cylindrical surface having the same radius of curvature as that of the machine-plate mounting surface 14. The machine-plate fixation member 24 has a projection 24*b*, which is formed on its radially inner end surface at an axially intermediate portion in such a manner as to project radially inward and which is fitted into a radially outer portion of the second recess 23. The radially inner end surface of the projection 24*b* serves as a wedge surface 24*c* which faces frontward and radially inward. A rectangular groove 25 is formed at each of two; i.e., front and rear, positions on one side wall of the machine-plate fixation member 24. A cutout portion 26 is formed at each of two; i.e., front and rear, positions on one side wall of the recess 22. Detachment prevention members 27 are fixed to the respective cutout portions 26 in such a manner that their end portions project into the recess 22. The detachment prevention members 27 are fitted into the respective grooves 25 of the machine-plate fixation member 24 with a clearance present in each of the front-rear direction and the radial direction, thereby allowing radial movement of the machine-plate fixation member 24 while preventing detachment of the machine-plate fixation member 24.

A wedge member 28 is fitted into the second recess 23 in such a manner as to be movable in the front-rear direction. The radially inner end surface of the wedge member 28 is a flat surface in slidable contact with the bottom wall of the recess 23. The wedge member 28 is fitted into the recess 23 with almost no clearance left in the circumferential direction and moves in the front-rear direction along the bottom wall and the two side walls of the recess 23. The radially outer end surface of the wedge member 28 serves as a wedge surface 28*a*, which faces rearward and radially outward in such a manner as to face the wedge surface 24*c* of the machine-plate fixation member 24. The wedge member 24 has internal threads 29 provided rearward from its front end surface.

First permanent magnets 30 are fixedly embedded in the wedge surface 24*c* of the machine-plate fixation member 24. Second permanent magnets 31 facing toward the first permanent magnets 30 are fixedly embedded in the bottom wall of the second recess 23. The first permanent magnets 30 and the second permanent magnets 31 are disposed in such a manner as to attract each other, and constitute urging means for urging the machine-plate fixation member 24 radially inward by means of the magnetic attraction so as to bring the wedge surface 24*c* of the machine-plate fixation member 24 in pressure contact with the wedge surface 28*a* of the wedge member 28.

A screw member 32 extends in the front-rear direction through a portion of the partition wall 17*a* located frontward of the second recess 23 and through the cover 42. The screw member 32 is supported in such a manner as to be rotatable but immovable in the front-rear direction, by a large-diameter hole 33 extending through the partition wall 17*a* in the front-rear direction and a small-diameter hole 34 extending through the cover 42 in the front-rear direction. The screw member 32 includes a screw portion 35 supported by the hole 33 of the partition wall 17*a* and the hole 34 of the cover 42, and a head piece 36, which is fixed to the front end of the screw portion 35 after the screw portion 35 is fitted into the hole 34 of the cover 42. The screw portion 35 is supported by the hole 33 of the partition wall 17*a* and the hole 34 of the cover 42. A rear portion of the screw portion 35 which extends into the second recess 23 has external threads 37 formed thereon. The external threads 37 are engaged with the internal threads 29 of the wedge member 28. The head piece 36 projects frontward of the cover 42 and has a large number of axially extending fine whirl-stop teeth 38 on its outer circumferential surface. A base end portion of a whirl-stop member 39 is fixed on the front end surface of the cover 42. The whirl-stop member 39 is formed of an elastic member, such as a metal plate. A pawl 40 formed at a free end portion of the whirl-stop member 39 is brought into pressure contact with a portion between adjacent teeth 38 formed on the outer circumferential surface of the head piece 36 of the screw member 32, thereby performing a function of stopping whirl of the screw member 32.

When the screw member 32 is rotated in a pressing direction, the wedge member 28 moves toward a pressing side (rearward); accordingly, the machine-plate fixation member 24 moves toward a pressing side (radially outward). When the screw member 32 is rotated in the reverse direction; i.e., in the press cancellation direction, the wedge member 28 moves toward a press cancellation side (frontward); accordingly, the machine-plate fixation member 24 moves toward a press cancellation side (radially inward). When the machine-plate fixation member 24 moves toward the pressing side to the farthest extent, the machine-plate fixation member 24 projects radially outward beyond the cylindrical surface including the machine-plate mounting surface 14. When the machine-plate fixation member 24 moves toward the press cancellation side to the farthest extent, the machine-plate fixation member 24 sinks radially inward under the cylindrical surface including the machine-plate mounting surface 14. The screw member 32 and the internal threads 29 of the wedge member 28 constitute screw means for axially moving the wedge member 28 and fixing the wedge member 28 at an axially arbitrary position.

When the machine plate 2 is to be attached to the above-mentioned machine-plate mounting device 3, the machine-plate fixation member 24 is fixed at a sunken position where the machine-plate fixation member 24 is sunk radially inward under the cylindrical surface including the machine-plate mounting surface 14, thereby being brought into a press cancellation state in which the machine-plate fixation member 24 does not press the machine plate 2. In this state, the machine plate 2 is fitted, from its one end portion, to the outer circumference of the machine-plate cylinder section 12 in such a manner that the engagement portion 6 of the machine plate 2 is fitted into the groove 21 of the machine-plate cylinder section 12 and that the one end portion of the machine plate 2 comes into contact with the stopper 20. By this procedure, the machine plate 2 is attached to the machine-plate cylinder section 12 at a predetermined position in an accurate, simple manner. Since the inner diameter of the machine plate 2 is greater than the outer diameter of the machine-plate mounting surface 14 and since, when the machine plate 2 is attached, the machine-plate fixation member 24 is located at the sunken position, a clearance exists between the machine plate 2 and the machine-plate mounting surface 14 and between the machine plate 2 and the machine-plate fixation member 24, so that the machine plate 2 can be readily attached to the machine-plate cylinder section 12. Upon attachment of the machine plate 2, the screw member 32 is rotated in the pressing direction so as to move the machine-plate fixation member 24 in the pressing direction. By this procedure, the machine-plate fixation member 24 is pressed against the inner circumference of the joint portion 8 of the machine plate 2, thereby bringing the machine-plate fixation member 24 into a pressing state in which the machine-plate fixation member 24 presses the machine plate 2 radially outward. When the machine-plate fixation member 24 applies a predetermined tensile force to the machine plate 2, and thus the machine plate 2 is brought in fixed close contact with the machine-plate mounting surface 14, the screw member 32 is stopped rotating and is fixed at the position by means of the whirl-stop member 39. Mounting of the machine plate 2 is thus completed. At this time, the entire frame area 5 is in close contact with the machine-plate mounting surface 14 via the machine-plate body 4.

During printing, the machine-plate cylinder section 12 is rotated in a state in which the machine plate 2 is fixed on the machine-plate cylinder section 12 as mentioned above. At this time, the machine plate 2 is brought in fixed close contact with the machine-plate mounting surface 14 by means of the machine-plate fixation member 24; furthermore, the projecting end of the engagement portion 6 of the machine plate 2 faces rearward with respect to the rotational direction R. Thus, the engagement portion 6 bites into the groove 21, so that the position of the machine plate 2 does not deviate. Also, since the claw 40 of the whirl-stop member 39 bites into a portion between adjacent teeth 38 of the head piece 36 of the screw member 32 by the effect of an elastic force, the screw member 32 is free from rotation which could otherwise result from subjection to vibration.

When the machine plate 2 which is mounted on the machine-plate cylinder section 12 as mentioned above is to be detached, the screw member 32 is rotated in the press cancellation direction so as to move the machine-plate fixation member 24 in the press cancellation direction. Then, the machine-plate fixation member 24 is fixed at the sunken position. By this procedure, a clearance is formed between the machine plate 2 and the machine-plate mounting surface 14 and between the machine plate 2 and the machine-plate fixation member 24. Thus, by means of axially moving the machine plate 2, the machine plate 2 can be readily detached from one end of the machine-plate cylinder section 12.

In the above-mentioned printer, water, which serves as a temperature control fluid whose temperature is regulated, is circulated in the machine-plate cylinder section 12 as described below.

In order to establish communication between the adjacent compartments 43, communication holes 44*b*, 44*c*, and 44*d*, one each, are formed in the partition walls 17*b*, 17*c*, and 17*d* in the machine-plate cylinder section 12; i.e., in the plurality of partition walls 17, except for one partition wall (in this example, the first partition wall 17*a*). The communication holes are generally denoted by reference numeral 44. For identification of the individual communication holes, the communication hole formed in the second partition wall 17*b* is called the second communication hole 44*b*; the one formed in the third partition wall 17*c* is called the third communication hole 44*c*; and the one formed in the fourth partition wall 17*d* is called the fourth communication hole 44*d*. The second communication hole 44*b* and the fourth communication hole 44*d* are formed in the partition walls 17*b* and 17*d*, respectively, at respective positions located toward the front and toward the outer circumference. The third communication hole 44*c* is formed in the partition wall 17*c* at a position located toward the rear and toward the outer circumference. The four compartments 43 which communicate with each other through the communication holes 44 collectively form a fluid circulation space.

The machine-plate drive shaft 1 has a liquid inflow channel 45 and a liquid outflow channel 46 formed therein and extending in the axial direction. The liquid inflow channel 45 is adapted to introduce water into the machine-plate cylinder section 12 and is formed in the machine-plate drive shaft 1 at an upper left position. The liquid outflow channel 46 is adapted to discharge water from the machine-plate cylinder section 12 and is formed in the machine-plate drive shaft 1 at an upper right position. A front portion of the liquid inflow channel 45 and that of the liquid outflow channel 46 are bent toward the outer circumference such that a front end portion 45*a* of the liquid inflow channel 45 reaches the outer circumference of the shaft taper portion 1*a* at a position which corresponds to the first compartment 43*a* and is located toward the rear of the shaft taper portion 1*a* and such that a front end portion 46*a* of the liquid outflow channel 46 reaches the outer circumference of the shaft taper portion 1*a* at a position which corresponds to the fourth compartment 43*d* and is located toward the rear of the shaft taper portion 1*a*. A rear portion of the liquid inflow channel 45 and that of the liquid outflow channel 46 are bent upward on the rear side of the bearing housing 11 such that their rear end portions 45*b* and 46*b* reach the outer circumference of the machine-plate drive shaft 1. The rear end portions 45*b* and 46*b* of the liquid inflow channel 45 and the liquid outflow channel 46, respectively, are positionally shifted from each other in the front-rear direction. In this example, the rear end portion 45*b* of the liquid inflow channel 45 is located frontward. The inner tubular portion 15 of the machine-plate cylinder section 12 has an inflow hole 47 formed therein for establishing communication between the liquid inflow channel 45 and the first compartment 43*a*, which is a compartment located at one end (inflow side) of the fluid circulation space, as well as an outflow hole 48 formed therein for establishing communication between the liquid outflow channel 46 and the fourth compartment 43*d*, which is a compartment located at the other end of the fluid circulation space.

Although a detailed illustration is omitted, a thick-walled cylindrical rotary joint 50 is fixed on the machine frame of the printer at a predetermined position. A portion of the machine-plate drive shaft 1 where the rear end portions 45*b* and 46*b* of the liquid inflow channel 45 and the liquid outflow channel 46, respectively, are present is fitted into the inner circumference of the rotary joint 50 in a watertight and rotatable manner. The rotary joint 50 has an annular inflow groove 51, corresponding to the liquid-inflow-channel rear end portion 45*b*, formed at a front portion of its inner circumference, and an annular outflow groove 52, corresponding to the liquid-outflow-channel rear end portion 46*b*, formed at a rear portion of its inner circumference. Although the machine-plate drive shaft 1 rotates in relation to the rotary joint 50, the liquid-inflow-channel rear end portion 45*b* faces the inflow groove 51 at all times, and the liquid-outflow-channel rear end portion 46*b* faces the outflow groove 52 at all times. One end portion of a liquid inflow pipe 53 and that of a liquid outflow pipe 54 are connected to the outer circumference of the rotary joint 50 and communicate with the inflow groove 51 and the outflow groove 52 via short connection channels 55 and 56, respectively. The other end portion of the inflow pipe 53 is connected to a discharge port of a pump 57, and the other end portion of the outflow pipe 54 is connected to a suction port of the pump 57. The liquid inflow channel 45 and the liquid outflow channel 46 of the machine-plate drive shaft 1, the rotary joint 50, the inflow pipe 53, the outflow pipe 54, and the pump 57 constitute fluid circulation means for circulating water in the fluid circulation space of the machine-plate cylinder section 12.

A heat exchanger 59 and a flow control valve 60, which are controlled by a controller 58, are provided on the inflow pipe 53. The flow control valve 60 serves as flow control means. Although detailed illustration is omitted, a temperature sensor 61 for detecting the temperature of the machine-plate cylinder section 12 is provided on the machine frame of the printer at a predetermined position. Preferably, the temperature sensor 61 is of a non-contact type; for example, an infrared temperature sensor. An output of the temperature sensor 61 is input to the controller 58. The temperature sensor 61, the controller 58, the heat exchanger 59, and the flow control valve 60 constitute temperature control means.

Water discharged from the discharge port of the pump 57 enters a rear portion of the first compartment 43*a* of the machine-plate cylinder section 12 through the liquid inflow pipe 53, the inflow groove 51 of the rotary joint 50, the liquid inflow channel 45 of the machine-plate drive shaft 1, and the inflow hole 47 of the inner tubular portion 15; flows frontward in the first compartment 43*a*; enters a front portion of the second compartment 43*b* through the communication hole 44*b* of the second partition wall 17*b*; flows rearward in the second compartment 43*b*; enters a rear portion of the third compartment 43*c* through the communication hole 44*c* of the third partition wall 17*c*; flows frontward in the third compartment 43*c*; enters a front portion of the fourth compartment 43*d* through the communication hole 44*d* of the fourth partition wall 17*d*; flows rearward in the fourth compartment 43*d*; flows through the outflow hole 48 of the inner tubular portion 15, the liquid outflow channel 46 of the machine-plate drive shaft 1, the outflow groove 52 of the rotary joint 50, and the outflow pipe 54; and returns to the pump 57 through the suction port. In this manner, water is circulated thoroughly in all the compartments 43, which constitute the fluid circulation space of the machine-plate cylinder section 12.

Meanwhile, the controller 58 controls the heat exchanger 59 and the flow control valve 60 on the basis of the temperature of the machine-plate cylinder section 12 detected by the temperature sensor 61. In this manner, the temperature of water circulating in the machine-plate cylinder section 12 is controlled. By means of circulation of temperature-regulated water, the temperature of the machine-plate cylinder section 12 is maintained within a predetermined range.

In the above-described embodiment, the screw member 32 for moving the machine-plate fixation member 42 is manually rotated, but may be rotated by means of motive power, such as electric power.

In the above-described embodiment, the machine-plate fixation member 24 is moved radially by means of axial movement of the wedge member 28. However, the machine-plate fixation member may be directly moved in a radial direction by manual operation or by means of motive power. Also, in the above-described embodiment, the machine plate 2 is pressed from the radial inside direction toward the radial outside direction by means of radial movement of the machine-plate fixation member 42. However, for example, the machine plate 2 may be pressed from the radial inside direction toward the radial outside direction by means of rotation of an eccentric fixation member.

Figure 10:
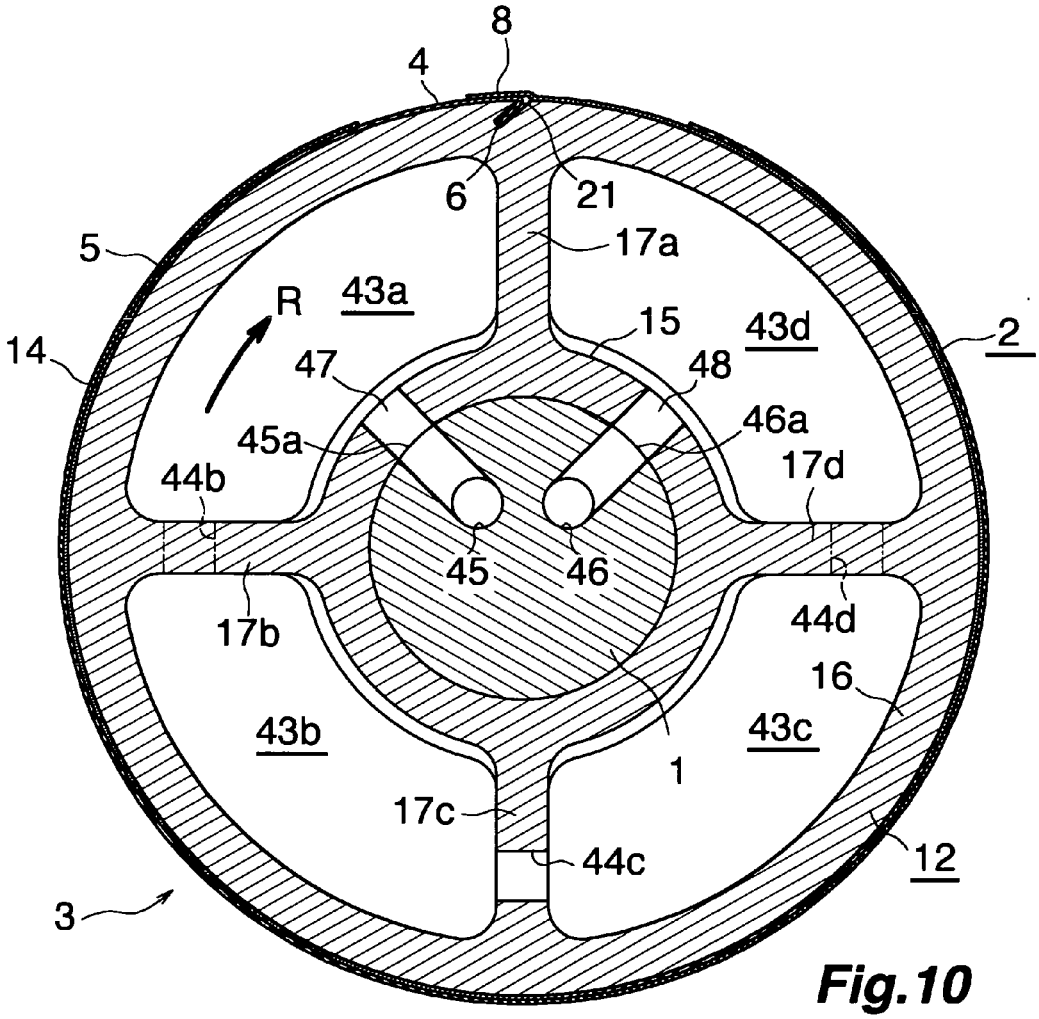
FIG. 10 is a cross-sectional view of a machine-plate mounting device of a printer according to a second embodiment of the present invention.

FIG. 10 shows a second embodiment of the present invention. In FIG. 10, members or portions corresponding to those of the first embodiment are denoted by like reference numerals.

The machine plate 2 used in the second embodiment is identical with that used in the first embodiment.

The machine-plate mounting device 3 differs from the machine-plate mounting device 3 of the first embodiment in that the machine-plate fixation member 24 and associated members or portions are eliminated. The entire outer circumference of the outer cylindrical portion 16 of the machine-plate cylinder section 12 serves as the cylindrical machine-plate mounting surface 14. As in the case of the first embodiment, the groove 21 for circumferential positioning is formed at a single portion of the machine-plate mounting surface 14.

The inner diameter of the machine plate 2 is slightly smaller than the outer diameter of the machine-plate mounting surface 14 of the machine-plate cylinder section 12 as measured at the same temperature.

When the machine plate 2 is to be attached to the machine-plate mounting device 3, the temperature of the machine-plate cylinder section 12 is lowered so as to render the inner diameter of the machine plate 2 slightly greater than the outer diameter of the machine-plate mounting surface 14 through shrinkage of the machine-plate cylinder section 12. If necessary, the machine plate 2 is placed beforehand in an environment having a relatively high temperature for expanding the machine plate 2. The machine plate 2 whose inner diameter is rendered greater than the outer diameter of the machine-plate mounting surface 14 is fitted, from its one end portion, to the outer circumference of the machine-plate cylinder section 12 in such a manner that the engagement portion 6 of the machine plate 2 is fitted into the groove 21 of the machine-plate cylinder section 12 and that the one end portion of the machine plate 2 comes into contact with the stopper 20. Subsequently, the temperature of the machine-plate cylinder section 12 is brought to an appropriate level. Consequently, the machine-plate cylinder section 12 and the machine plate 2 have the same temperature, so that the machine plate 2 is fixed to the machine-plate mounting surface 14 in a press fit condition. When the machine plate to be detached from the machine-plate mounting device 3, the temperature of the machine-plate cylinder section 12 is lowered, and, as needed, the temperature of the machine plate 2 is increased, so as to render the inner diameter of the machine plate 2 slightly greater than the outer diameter of the machine-plate mounting surface 14.

Other configurational features are similar to those of the first embodiment.

In the above-described two embodiments, the machine plate may be such that a separately made engagement piece, which serves as the engagement portion, is fixed to the cylindrical machine-plate body.

Figure 11:
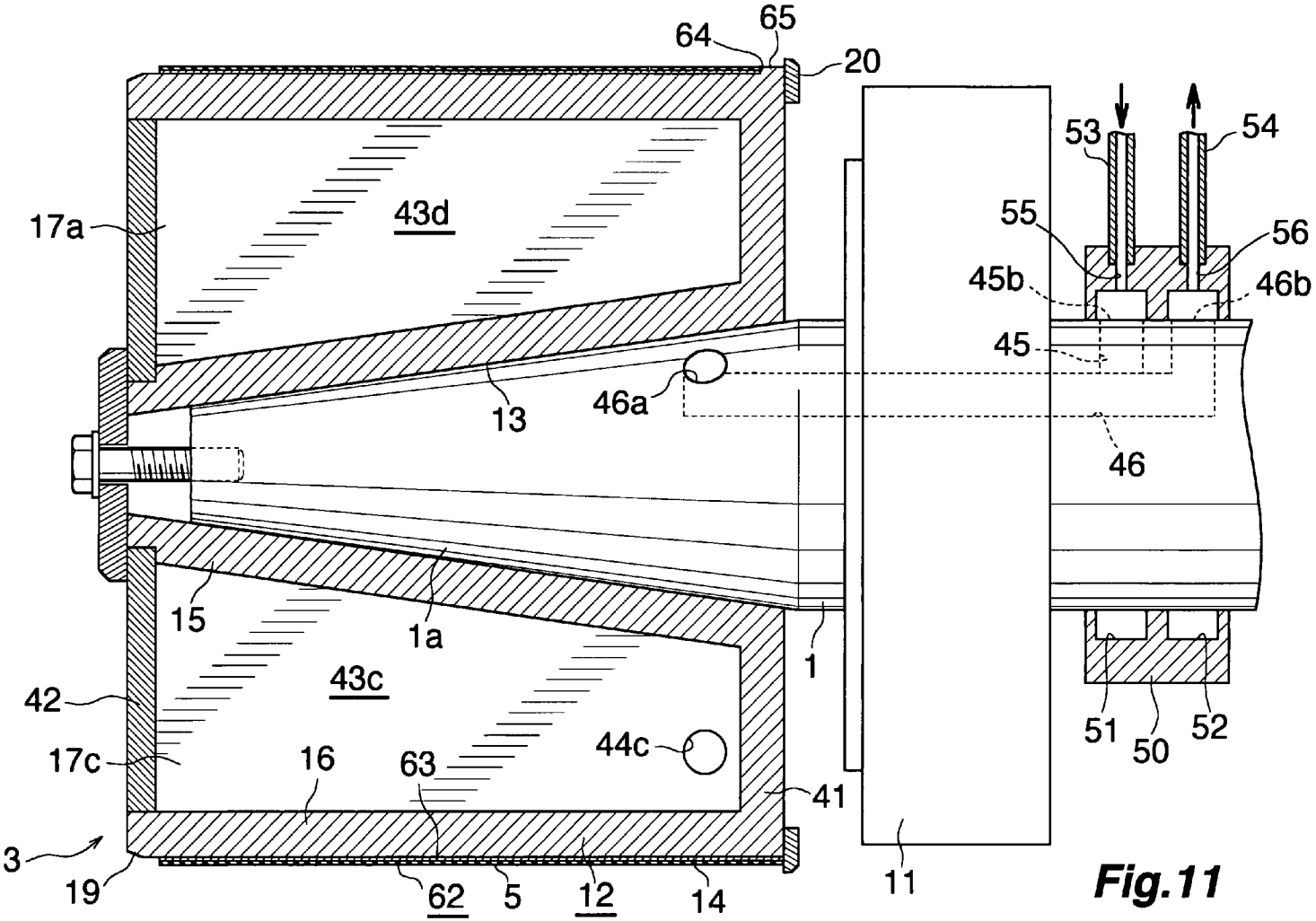
FIG. 11 is a vertical sectional view of a machine-plate mounting device of a printer according to a third embodiment of the present invention.
Figure 12:
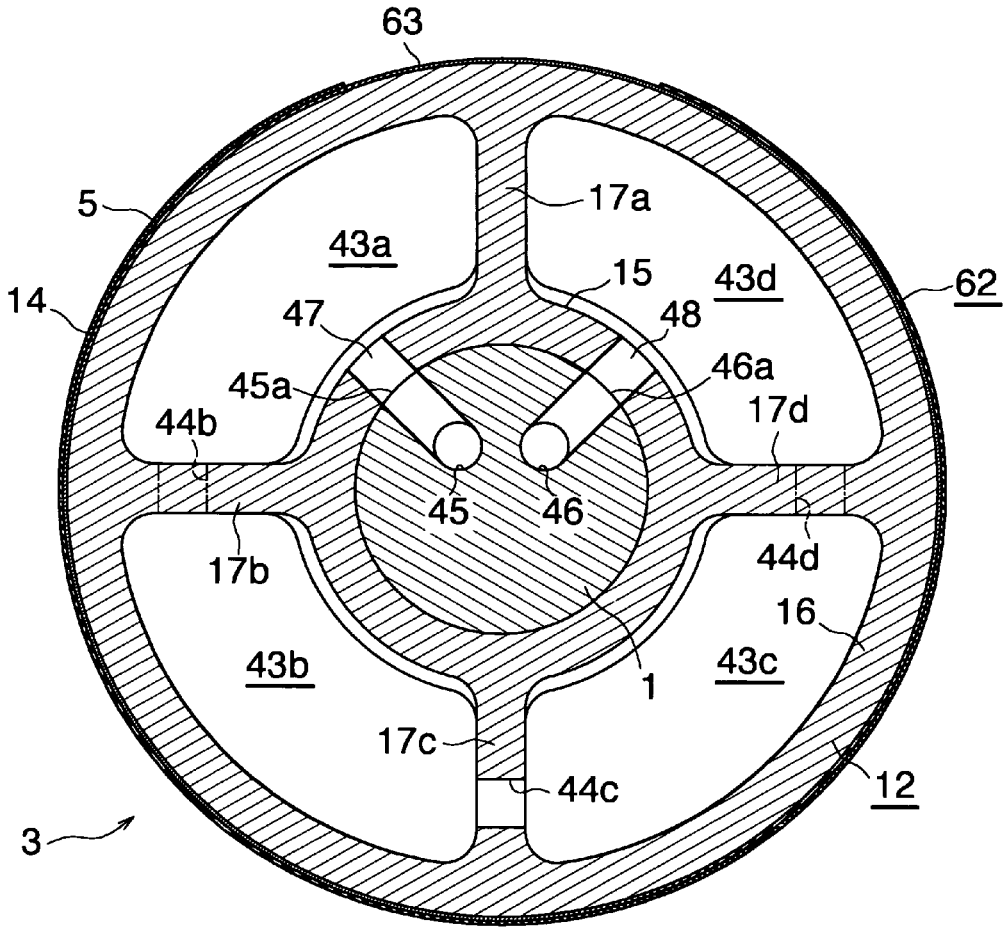
FIG. 12 is a cross-sectional view of the machine-plate mounting device.

FIGS. 11 and 12 show a third embodiment of the present invention. In FIGS. 11 and 12, members or portions corresponding to those of the first and second embodiments are denoted by like reference numerals.

A machine plate 62 to be used in the third embodiment has a forme area formed on at least a portion of the outer circumferential surface of a cylindrical machine-plate body 63, and a concavity 64, which partially constitutes a concavity-convexity for circumferential positioning, formed at one end portion of the machine-plate body 63. The machine plate 62 does not have a structural feature corresponding to the engagement portion 6 of the machine plate 2 used in the above-described two embodiments. The concavity 64 is, for example, semicircular as viewed from the radial outside direction.

The machine-plate cylinder section 12 of the machine-plate mounting device 3 differs from the machine-plate cylinder section 12 of the second embodiment in that the groove 21 for circumferential positioning is eliminated. The entire outer circumference of the outer cylindrical portion 16 of the machine-plate cylinder section 12 serves as the cylindrical machine-plate mounting surface 14. A convexity 65, which, together with the concavity 64 of the machine plate 62, constitutes the concavity-convexity for circumferential positioning, is formed on the outer cylindrical portion 16 of the machine-plate cylinder section 12 at its rear end portion located frontward of the stopper 20. The convexity 65 is, for example, semicircular as viewed from the radial outside direction.

The inner diameter of the machine plate 62 is slightly smaller than the outer diameter of the machine-plate mounting surface 14 of the machine-plate cylinder section 12 as measured at the same temperature.

When the machine plate 62 is to be attached to the machine-plate mounting device 3, the temperature of the machine-plate cylinder section 12 is lowered, and, as needed, the temperature of the machine plate 62 is increased, so as to render the inner diameter of the machine plate 62 slightly greater than the outer diameter of the machine-plate mounting surface 14. If necessary, the machine plate 62 is placed beforehand in an environment having a relatively high temperature for expanding the machine plate 62. The machine plate 62 whose inner diameter is rendered greater than the outer diameter of the machine-plate mounting surface 14 is fitted, from its one end portion, to the outer circumference of the machine-plate cylinder section 12 in such a manner that the one end portion of the machine plate 62 comes into contact with the stopper 20 and that the concavity 64 and the convexity 65 for circumferential positioning are fitted to each other. Subsequently, the temperature of the machine-plate cylinder section 12 is brought to an appropriate level. Consequently, the machine-plate cylinder section 12 and the machine plate 62 have the same temperature, so that the machine plate 62 is fixed to the machine-plate mounting surface 14 in a press fit condition. When the machine plate 62 is to be detached from the machine-plate mounting device 13, the temperature of the machine-plate cylinder section 12 is lowered, and, as needed, the temperature of the machine plate 62 is increased, so as to render the inner diameter of the machine plate 62 slightly greater than the outer diameter of the machine-plate mounting surface 14.

The overall and component-level configurations of the printer, the machine-plate mounting device 3, and the machine plates 2 and 62 are not limited to those of the above-described embodiments and may be modified as appropriate.

The machine plate may not have the above-mentioned cylindrical shape. For example, a single or a plurality of forme sheets may be mounted on the outer circumference of the machine-plate cylinder section by appropriate means.

INDUSTRIAL APPLICABILITY

The present invention is suitably applied to printers. A printer according to the present invention can facilitate temperature control of a machine-plate cylinder section, can allow simple setup, and can facilitate maintenance of printing quality in continuous printing.

The invention claimed is:

1. A system comprising:

a printer including a machine plate; and a machine-plate cylinder section fixedly provided on a machine-plate drive shaft, the machine plate being mounted on an outer circumference of the machine-plate cylinder section, wherein:

a fluid circulation space is formed in the machine-plate cylinder section, and there are provided fluid circulation means for circulating a temperature control fluid in the fluid circulation space and temperature control means for controlling temperature of the temperature control fluid according to a temperature of the machine-plate cylinder section, the machine-plate cylinder section has: i) an inner tubular portion into which the machine-plate drive shaft is fitted, ii) an outer cylindrical portion whose outer circumference has a machine plate mounted thereon, and iii) end walls for tightly closing up respective opposite ends of the machine-plate cylinder section, such that a space between the inner tubular portion and the outer cylindrical portion is divided into a plurality of compartments by means of partition walls, a communication hole is formed in each of the partition walls except for one partition wall, and the plurality of compartments, which communicate with one another through the communication hole, form the fluid circulation space, and an inflow hole for establishing communication between a liquid inflow channel of the machine-plate drive shaft and a first compartment located at the one end of the fluid circulation space and an outflow hole for establishing communication between a liquid outflow channel of the machine-plate drive shaft and a second compartment located at the other end of the fluid circulation space are formed, characterized in that:

a front end portion of the machine-plate drive shaft is formed into a taper portion, and a tapered inner tubular portion of the machine-plate cylinder section is fitted to the taper portion, the inflow hole and the outflow hole, for establishing communication, are formed in the inner tubular portion, and the machine-plate drive shaft has the liquid inflow channel for allowing the temperature control fluid through the inflow hole to flow into the first compartment located at one end of the fluid circulation space, and the liquid outflow channel for allowing the temperature control fluid through the outflow hole to flow out from the second compartment located at the other end of the fluid circulation space, formed therein.

2. The system according to claim 1, wherein the fluid circulation means comprises a pump, a liquid inflow pipe and a liquid outflow pipe which are connected to the pump, and a rotary joint for establishing communication between the liquid inflow pipe and a liquid inflow channel of the machine-plate drive shaft and communication between the liquid outflow pipe and a liquid outflow channel of the machine-plate drive shaft.

3. The system according to claim 1, wherein the temperature control means detects temperature of the machine-plate cylinder section and controls temperature of the temperature control fluid in the liquid inflow pipe on the basis of the detected temperature of the machine-plate cylinder section so that temperature of the machine-plate cylinder section falls within a predetermined range.

4. The system according to claim 3, wherein the temperature control means comprises a temperature sensor for detecting temperature of the machine-plate cylinder section, a heat exchanger provided on the liquid inflow pipe, and a controller for controlling the heat exchanger on the basis of the detected temperature of the machine-plate cylinder section.

5. The system according to claim 4, wherein the temperature control means further comprises flow control means provided in the liquid inflow pipe, and the controller controls the flow control means on the basis of the detected temperature of the machine-plate cylinder section.

6. The system according to claim 1, wherein:

the partition walls comprise at least a first partition wall, a second partition wall, a third partition wall, and a fourth partition wall, and a second communication hole formed in the second partition wall and a fourth communication hole formed in the fourth partition wall are located toward an end close to the inflow hole, and a third communication hole formed in the third partition wall is located toward an end far from the inflow hole.

7. The system according to claim 1, wherein:

the liquid flow channel and the liquid outflow channel are extending in an axial direction, a front portion of the liquid inflow channel and a front portion of the liquid outflow channel are bent toward an outer circumference, such that a front end portion of the liquid inflow channel reaches the outer circumference of a shaft taper portion at a position which corresponds to the first compartment, the front end portion of the liquid inflow channel being located toward a rear of the shaft taper portion, and such that a front end portion of the liquid outflow channel reaches the outer circumference of the shaft taper portion at a position which corresponds to the second compartment, the front end portion of the liquid outflow channel being located toward the rear of the shaft taper portion, and a rear portion of the liquid inflow channel and a rear portion of the liquid outflow cannel are bent upward on a rear side of a bearing housing, such that their rear end portions reach the outer circumference of the machine-plate drive shaft, and the rear end portions of the liquid flow channel and the liquid outflow cannel, respectively, are positionally shifted from each other in a front-rear direction.

* * * * *